US006571403B2

(12) United States Patent
Wheaton

(10) Patent No.: US 6,571,403 B2
(45) **Date of Patent: *Jun. 3, 2003**

(54) POOLSIDE ACCESSORY ATTACHMENT SYSTEM

(76) Inventor: Michael David Wheaton, 8712 Summer Point Dr., Elk Grove, CA (US) 95624

( * ) Notice: Subject to any disclaimer, the term of this patent is extended or adjusted under 35 U.S.C. 154(b) by 0 days.

This patent is subject to a terminal disclaimer.

(21) Appl. No.: 09/775,961

(22) Filed: Feb. 3, 2001

(65) Prior Publication Data

US 2002/0104157 A1 Aug. 8, 2002

(51) Int. Cl.[7] ..... E04H 4/00

(52) U.S. Cl. ..... 4/496

(58) Field of Search ..... 4/496; 248/534, 248/539, 523, 545

(56) References Cited

U.S. PATENT DOCUMENTS

| | | | | | |
|---|---|---|---|---|---|
| 1,653,897 | A | * | 12/1927 | Farr | 131/241 |
| 5,082,231 | A | * | 1/1992 | Knowles | 248/545 |
| 5,383,644 | A | * | 1/1995 | Huse | 248/523 |
| 5,860,171 | A | * | 1/1999 | Hicks | 4/496 |
| 6,209,147 | B1 | * | 4/2001 | Wheaton | 4/496 |

* cited by examiner

*Primary Examiner*—Robert M. Fetsuga
*Assistant Examiner*—Peter deVore
(74) *Attorney, Agent, or Firm*—Risto A. Rinne, Jr.

(57) ABSTRACT

A system for attaching accessories to a base structure that is disposed at grade level proximate an aquatic environment includes an upright pedestal support assembly that is detachably-attachable with respect to the base by a twist-lock "bayonet" type of a mounting system. This permits the pedestal support assembly to be attached to the base and removed therefrom as desired. The pedestal support assembly is used to support any of a variety of poolside accessories. Additional base structures may be disposed either at grade level or underwater or both. Accordingly, any of the poolside accessories are interchangeable with respect to any of the base structures.

22 Claims, 5 Drawing Sheets

POOLSIDE ACCESSORY ATTACHMENT SYSTEM

This application is related to a prior application, entitled "Underwater Attachment System", filed on Dec. 31, 1998, application Ser. No. 09/224,418, which has been approved for issuance as a patent and which is presently copending.

BACKGROUND OF THE INVENTION

1. Field of the Invention

The present invention, in general relates to swimming pool accessories and, more particularly, to a system for interchangeably attaching umbrellas, tables, stools, benches, games, and other accessories to a base structure that is disposed above the water proximate a swimming pool or other type of aquatic environment.

The need for attaching underwater accessories, such as an umbrella or a table or a bench or stool or game in the water are addressed in the aforementioned patent application. However, there is a need to be able to interchange accessories from a location that is disposed under the water (such as in a swimming pool or hot tub) to a location that is above the water and proximate the swimming pool or hot tub.

The utility of umbrellas and benches, stools, tables, and games are well known both in and out of the water. When people are in a swimming pool, they may well enjoy the use of an umbrella and bench for a respite, for example.

However, at other times the need for the bench or umbrella in the water will be lessened and, at times, they will not be needed in the water at all. Perhaps, during such times, the guests will prefer to congregate on dry land proximate the swimming pool where they will still have need of an umbrella and bench or other type of poolside accessory.

Above ground accessories, for example, umbrellas and benches, stools, tables, etc. are normally placed on the ground (or on a concrete or a tiled surface that is disposed proximate the swimming pool or hot tub) and are retained in position by gravity. Often times the table alone will support the umbrella which is typically located in the center thereof.

When there is wind these accessories may move and become damaged. They can also be bumped and tipped over. It is advantageous to be able to secure poolside accessories in place, where desired.

It is important to note that when poolside accessories are used in the water, these accessories weigh less than they do on dry land and, quite likely, are not stable unless they are anchored in place. While they are more heavy when they are out of the water, they still need to be anchored.

Furthermore, the use of a pedestal that is secured to a base on land (i.e., out of the water) can greatly simplify these structures. Inherent stability is provided by this type of a mounting. Accordingly, there is far less need for consideration of how to stabilize these accessories on land.

Typical prior methods for stabilizing land-based structures have included, among others, the use of a two three or four-legged structure to support chairs, benches, tables, etc. Basketball posts and other types of sport related support structures are often embedded in a poured concrete base and are therefore permanently affixed to the base at a particular location.

This leads to another need for a versatile poolside accessory attachment system for use on land (out of the water) that is adapted to support various poolside accessories.

A basketball support structure (for example) may normally be disposed at grade level adjacent to a swimming pool where people in the water attempt to shoot baskets. When a congregation of people wish to socialize by the swimming pool, it is desirable to move the basketball support structure to a more remote location.

Children, for example, can play basketball on land or at another end of the swimming pool while the adults who are congregating at a preferred area adjacent to the swimming pool can relax without fear arising from the intensity of having basketballs continue to periodically hurtle past them.

Also, there is a need to maximize the demands of the moment without having to make redundant purchases of poolside accessories. If normally there is one umbrella and table above ground and one disposed in the swimming pool then, when a larger number of guests arrive such as during a wedding reception or other type of social gathering, the need for above ground accessories will increase.

If the maximum number of above ground accessories were always present above ground, then the area would likely appear cluttered with benches and umbrellas, games, stools, and tables when fewer people are present.

Sometimes, people will not want to play in the water for any number of reasons. For example, some people may have water phobia issues and may not wish to enter the water to play a game such as either volley ball or basketball but would be willing to play if the game was played on dry land.

Also, the temperature may be such that some would find it too chilly to enter the water but would be content to stay on land. Therefore, there is a need to be able to remove an aquatic accessory that is disposed in the water and to use that accessory out of the water.

Conversely, if a game or accessory were permanently attached above ground (so as to resist movement by the wind) there will be times when people would prefer to play that game or have that accessory disposed in the water.

Clearly, the ability to detach any of the above accessories to provide an open above ground area and to use them either in the water or on land is desirable.

Also, having a capability to be able to substitute one type of a poolside accessory for another on land, such as being able to readily substitute a tetherball structure in the same location adjacent to a swimming pool that was occupied by the basketball structure would be especially useful and desirable. People either in the water or on land could play different games on demand at the same location.

Accordingly, there exists today a need for a poolside accessory attachment system that includes a base or plurality thereof that are attached at grade level on dry land to which a variety of poolside accessories, such as are mentioned hereinbefore and hereinafter, are detachably-attachable with respect to the base and which may be interchangeably used with similar types of bases that are disposed underwater.

Clearly, such a system would be especially useful and desirable.

2. Description of Prior Art

Above water use of umbrellas or tables and other types of poolside accessories are, in general, known. However, these types of devices, once installed, are either permanently installed or they are portable above ground and are not adaptable for attachment to a base that is disposed underwater or they have other limitations as are briefly discussed herein.

While the structural arrangements of the above described devices, at first appearance, may have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a poolside accessory attachment system that can be used proximate a swimming pool.

It is also an important object of the invention to provide a poolside accessory attachment system that can be used proximate a hot tub.

Another object of the invention is to provide a poolside accessory attachment system that includes a base that disposed on land and above the water and which can receive and support an accessory that is attached thereto.

Still another object of the invention is to provide a poolside accessory attachment system that includes a base adapted to detachably receive an accessory that is useful in an aquatic environment.

Still yet another object of the invention is to provide a poolside accessory attachment system that can be used to attach a support pedestal to a base that is disposed on land.

Still yet one further desirable object of the invention is to provide a poolside accessory attachment system that can be used to interchange a support pedestal intermediate a first base that is disposed on land with a second base that is disposed underwater.

Yet another important object of the invention is to provide a poolside accessory attachment system that includes a support pedestal, that is detachably attachable to a base.

Still yet another important object of the invention is to provide a poolside accessory attachment system that can secure a table to a base that is disposed proximate an aquatic environment, such as near a swimming pool or hot tub.

One other important object of the invention is to provide a poolside accessory attachment system that can secure an umbrella to a base that is disposed proximate an aquatic environment, such as near a swimming pool or hot tub.

One further important object of the invention is to provide a poolside accessory attachment system that can secure a bench to a base that is disposed proximate an aquatic environment, such as near a swimming pool or hot tub.

One still further important object of the invention is to provide a poolside accessory attachment system that can secure a stool to a base that is disposed proximate an aquatic environment, such as near a swimming pool or hot tub.

Yet one more important object of the invention is to provide a poolside accessory attachment system that can secure a support for a game to a base that is disposed proximate an aquatic environment, such as near a swimming pool or hot tub.

One still further especially important object of the invention is to provide a poolside accessory attachment system that includes a base disposed at grade level and having a twist-on and twist-off type of a mounting system for attaching and detaching a support pedestal.

Briefly, a poolside accessory attachment system for use proximate an aquatic environment that is constructed in accordance with the principles of the present invention has a base attached to a structure above the water with its top nearly flush with the grade surface to which it is attached. The base includes a method to detachably-attach a support pedestal thereto. The support pedestal is adapted to provide support for a variety of devices that are attached thereto. For example, it can provide support for an umbrella (to provide shade) or for a table, or for both simultaneously. The support pedestal can also provide support for a stool to sit on or, when used in concert with at least one additional base, a bench. It can be used to support any desired device, including a variety of games. For example the support pedestal when attached to the base can be used to support a basketball hoop and backboard. As the support pedestal is detachable apart from the base, it can be removed to provide an open area or it can be replaced when desired by another support pedestal adapted to provide an alternative benefit. According to a preferred embodiment, the support pedestal is adapted to twist on or off from the base and uses a type of "bayonet" mounting system. The base is attached to a structure, typically concrete, and the pedestal support is detachably-attachable thereto. The base is also adapted for use underwater. When additional bases are installed underwater, the support pedestal (and any poolside accessory that is attached thereto) is adapted for use in the water.

DETAILED DESCRIPTION OF THE INVENTION

Figure 1:
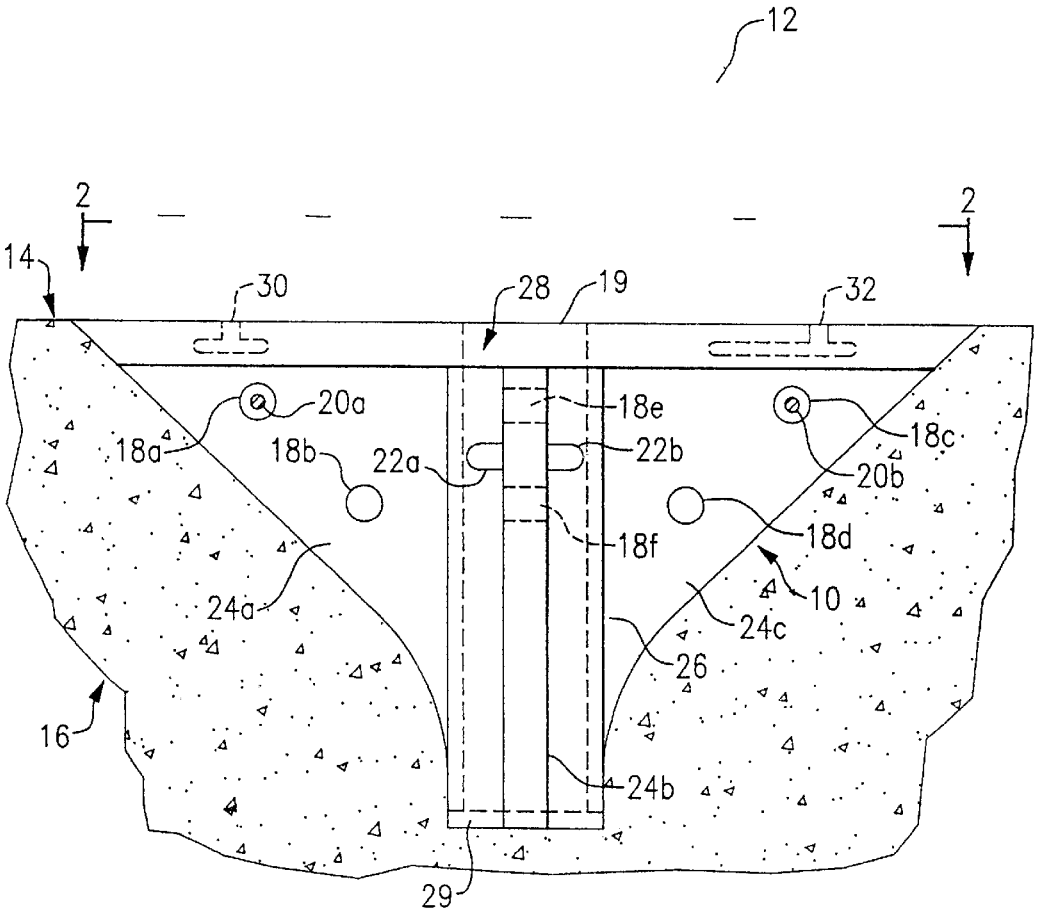
FIG. 1 is a side view of a base of the poolside accessory attachment system installed at grade level.

Referring to FIG. 1 is shown, a base, identified in general by the reference numeral 10. Air 12 is above the base 10.

A surface 14 is disposed at grade level. The surface 14 may be a patio, a walkway, a tiled surface, or it may include the surface area that is proximate a swimming pool (not shown) or a hot tub (not shown).

The surface 14 may be the top of a structure that is formed of concrete 16. A specific type of the concrete 16 is known as gunite and is also identified in general by the reference numeral 16. Gunite 16 is a type of air-blown concrete that is well known in the construction arts and, as shown, surrounds the base 10. Any other type of poured concrete may be used as well.

The base 10 includes a plurality of holes 18*a–f*. The holes 18*a–f* are used to better secure the base 10 to the concrete 16. During installation when the concrete 16 is poured or blown, it fills in certain of the holes 18*b*, 18*d*, 18*e*, and 18*f*, and therefore better secures the base 10 to the concrete 16.

The base 10 is placed so that a top 19 is nearly flush with the surface 14. Two of the holes 18*a* and 18*c* have a reinforcing bar 20*a* and 20*b* passing through them and into the concrete 16. The reinforcing bars 20*a*, 20*b* are also useful in securing the base 10 in the proper position by fastening them to other reinforcing bars (not shown) that are dispersed throughout the area that is to be filled with the concrete 16.

Another way to better secure the base 10 to the gunite 16 is by the use of a plurality of protrusions 22*a* 22*b* that are formed as part of the base 10.

The base 10 includes the top 19, and a plurality of tapered members 24*a*, 24*b*, and 24*c* that are wider where they are attached to the top 19 and narrower at an opposite or bottom end. A fourth tapered member (not shown in this drawing) is disposed on the side opposite the second tapered member 24*b*.

A center cylindrical member 26 extends from the top 19 to the bottom of the tapered members 24*a–c*. The tapered members 24*a–c* are attached to the center cylindrical member 26 along its entire length. The tapered members 24*a–c* each function as a gusset intermediate the center cylindrical member 26 and the top 19 and add strength to the overall assembly (as well as in helping to secure the base 10 to the surrounding concrete 16).

The center cylindrical member 26 includes a hollow interior 28 that extends from the top 19 to a bottom plate 29 that, preferably, forms a seal at the bottom of the base 10.

A first arcuate slot 30 and a second arcuate slot 32 (a third arcuate slot is not shown in this drawing) are provided in the top 19.

Figure 2:
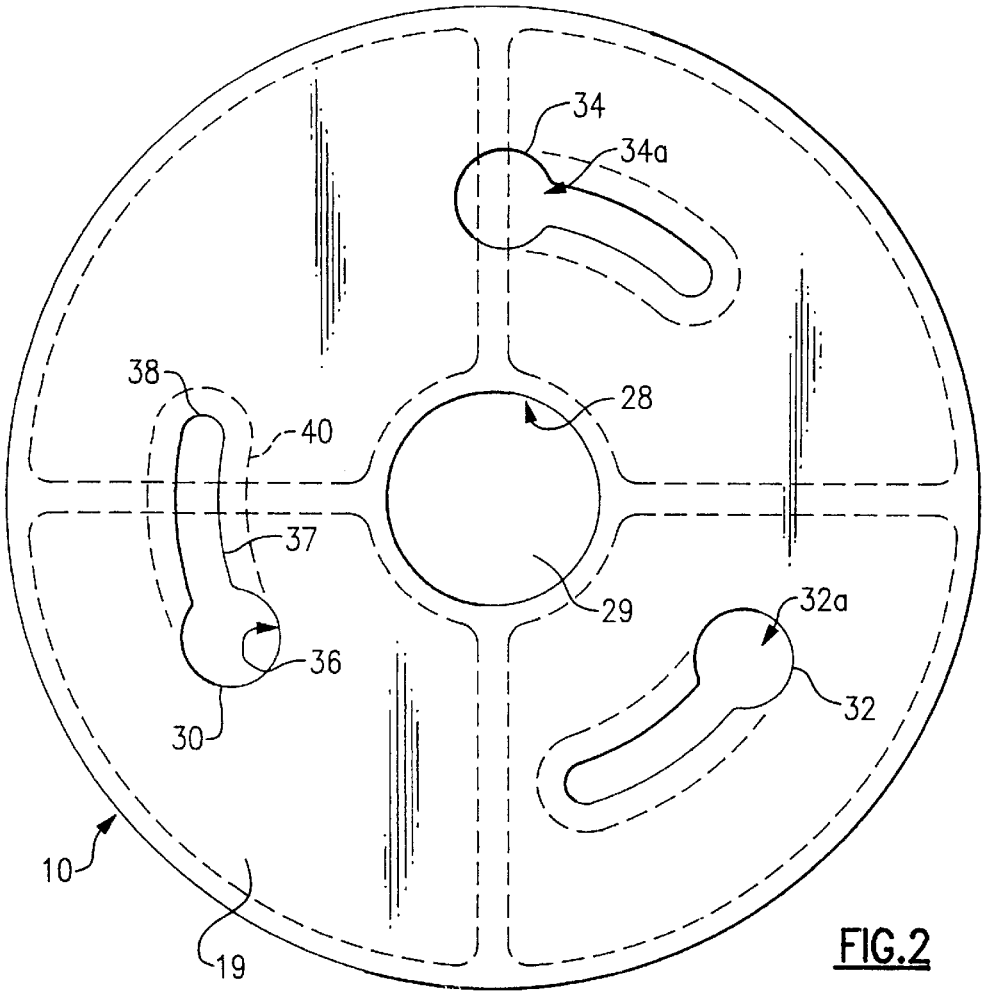
FIG. 2 is a view as shown in FIG. 1 as seen along the lines 2—2 therein.

Referring now to FIG. 2, the third arcuate slot 34 is shown along with the first and second arcuate slots 30, 32. They are each constructed so as to be the same and so the following detail of construction for the first arcuate slot 30 applies to all of them.

The first arcuate slot 30 includes a large circular opening 36 at one end that is open to the top 19. A narrower curved opening 37 extends from the circular opening 36 to its point of termination which is called a first stop 38. An interior slot 40 matches the curvature of the curved opening 37 and is as wide as is the large circular opening 36. The first arcuate slot 30 including the circular opening 36, the narrower curved opening 37 and the interior slot 40 are contained within the top 19.

The second and third arcuate slots 32, 34 are similarly constructed and are spaced equidistant with respect to each other. The first second and third arcuate slots 30, 32, 34 are used to form a mounting system to attach a pedestal support 50 (see FIG. 3) thereto. This type of a mounting system is known as a "bayonet" mount and is described in greater detail hereinafter.

Figure 3:
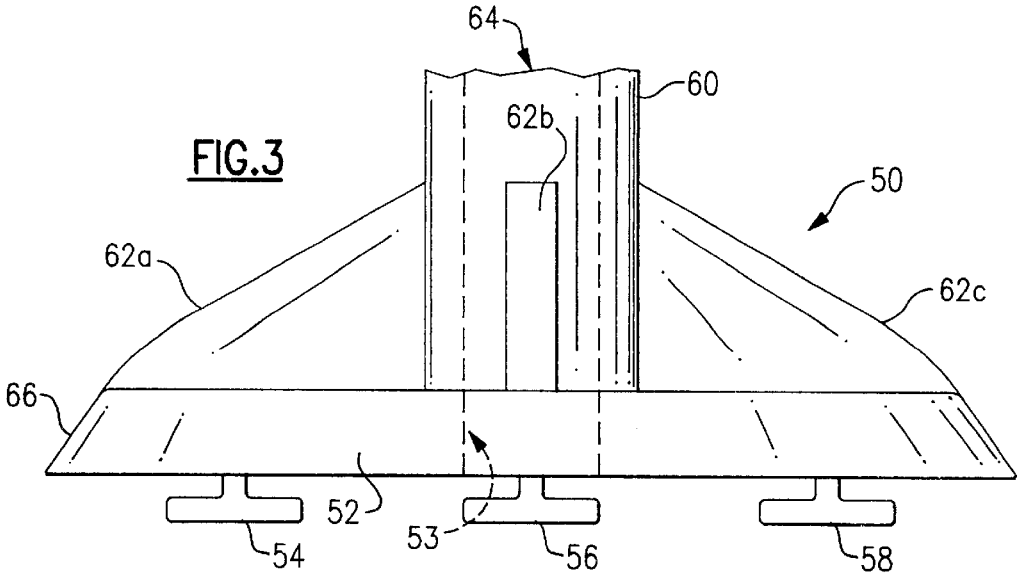
FIG. 3 is a side view of a portion of a pedestal support of the poolside accessory attachment system adapted to cooperate with the base of FIGS. 1 and 2.

Referring now to FIG. 3, the pedestal support 50 includes a circular base plate 52 to which are attached a first T-shaped member 54, a second T-shaped member 56, and a third T-shaped member 58.

An upright pedestal 60 extends upward at a right angle with respect to the plane defined by the base plate 52. A plurality of gusset plates 62*a,b,c* provide strength to the upright pedestal 60 and are disposed intermediate the upright pedestal 60 and the base plate 52, to which they are each attached.

The upright pedestal 60 preferably includes a hollow interior opening 64 that extends longitudinally along the length of the upright pedestal 60 and which extends through the base plate 52. The hollow interior opening 64 is useful for routing of cables and is discussed in greater detail hereinafter.

The base plate 52 includes a tapered edge 66 around the circumference thereof that includes an angled surface so that the base plate 52 has a greater diameter at the bottom and a lesser diameter at the top (closer to the upright pedestal 60). The tapered edge 66 prevents the toes of a user (not shown) from being stubbed by bumping up against what would otherwise be a flat edge.

In use, the pedestal support 50 is attached to the base 10 during use and is removable therefrom as desired. To attach the pedestal support 50 to the base 10, it is held above the base 10 and lowered so that one of the T-shaped members 54, 56, 58 aligns with and enters into the large circular opening 36 of the first arcuate slot 30 and the remaining two of the three T-shaped members 54, 56, 58 align with and enter into a corresponding large circular opening 32*a* of the second arcuate slot 32 and a large circular opening 34*a* of the third arcuate slot 34.

The pedestal support 50 is then rotated clockwise to move the T-shaped member (either 54, 56, or 58) along the narrower curved opening 37 until it reaches the first stop 38. The remaining two T-shaped members similarly rotate within the second and the third arcuate slots 32, 34 thereby securing the pedestal support 50 in a position of cooperation adjacent the base 10.

This type of a mounting, as mentioned hereinabove, is sometimes called a "bayonet" mount. To remove the pedestal support 50 from the base 10 the procedure is merely reversed by rotating the pedestal support 50 fully counterclockwise and lifting it off of the base 10. When the pedestal support 50 is attached to the base 10 as described hereinabove a tight secure alignment is achieved that positively holds the pedestal support 50 in an upright orientation.

The base 10 and the pedestal support 50 are formed of any desired material. Fiberglass, plastics, composites like graphite, and even certain metals are all candidate materials. The selection of the material used for the base 10 and the pedestal support 50 (as well as all remaining component parts as are discussed in greater detail hereinbelow) is based upon various considerations involving manufacturing costs and ease, aesthetics, durability, and weight to name just a few.

Another important consideration is the load that they will be subjected to. For example, a table 118 (FIG. 4) is shown attached to the upright pedestal 60 of the pedestal support 50 and is discussed in greater detail hereinbelow. If the table 100 is large and heavy then a stronger base 10 and pedestal support 50 will be required. This obviously affects the choice of materials including the schedule (thickness of the material) that is selected.

Figure 5:
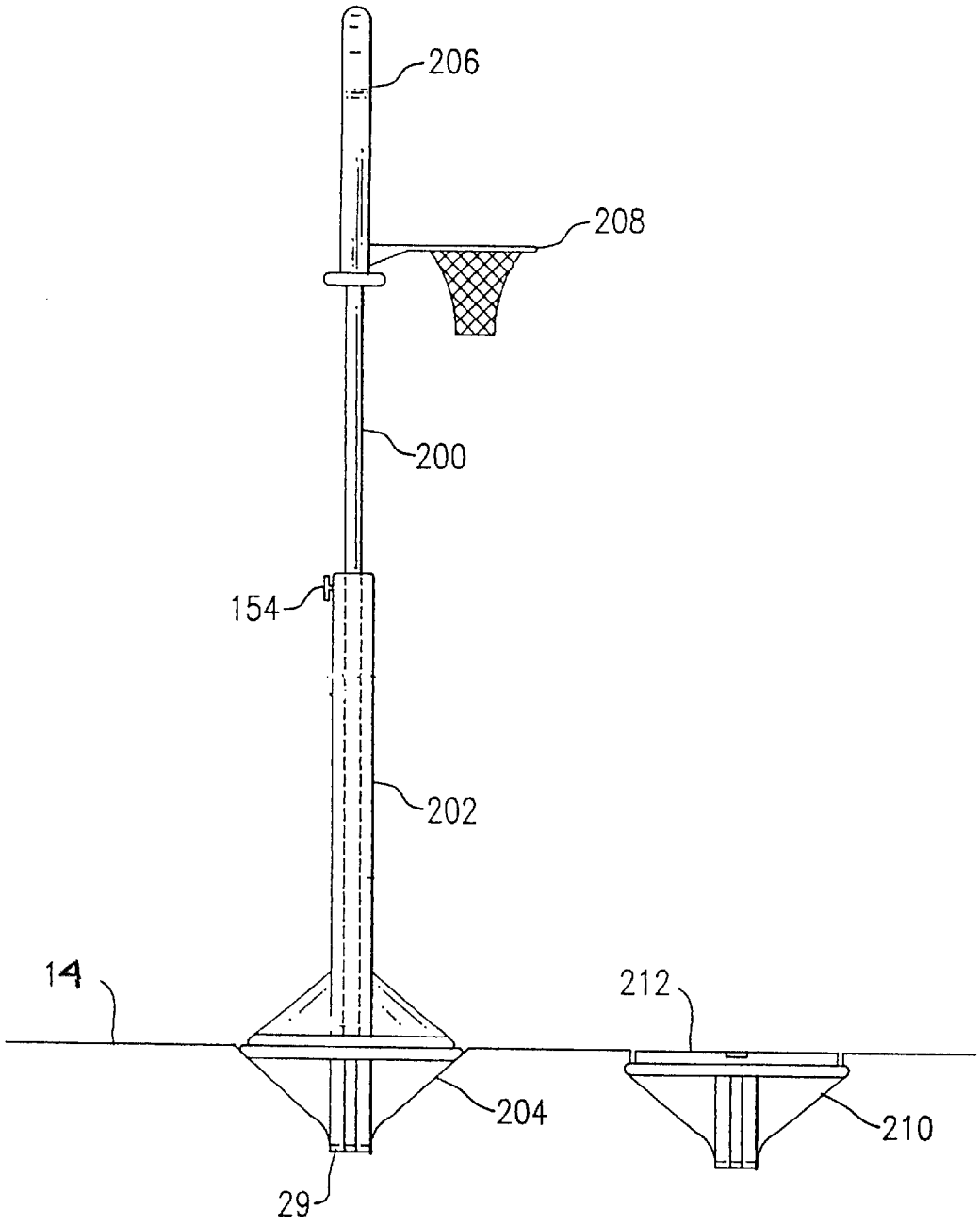
FIG. 5 is a side view of one possible recreational use of the poolside accessory attachment system.

If desired, the top 19 of the base 10 can be set slightly below the plane of the surface 14 so that when the base plate 52 is attached to the base 10, the top of the base plate 52 is flush with the plane of the surface 14. In this instance the tapered edge 66 can be eliminated if desired as there is no danger that the toes of the user can impact upon it. This is shown in FIG. 5 and is discussed in greater detail hereinafter.

Thus far the construction and the cooperative use of the pedestal support 50 and the base 10 have been discussed. The pedestal support 50 provides a structure that serves as a platform for attaching numerous poolside accessories that improve the environment surrounding an aquatic area. As such the base 10 and the pedestal support form the essential building blocks of the system.

Figure 4:
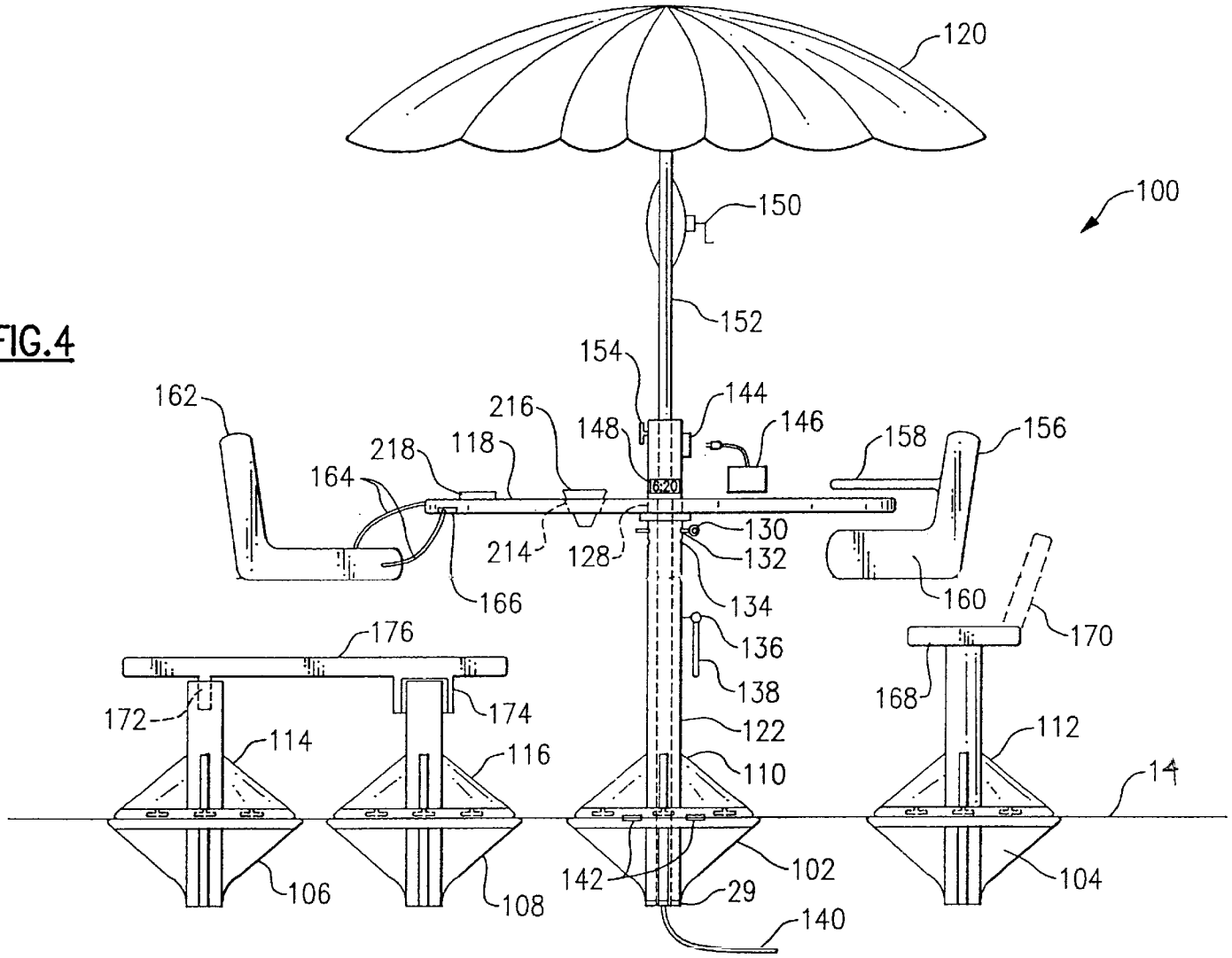
FIG. 4 is a side view of the poolside accessory attachment system disposed at grade level near a swimming pool showing several preferred embodiments of the system.

Referring now also to FIG. 4, is shown a poolside accessory attachment system, identified in general by the reference numeral 100 in use at an aquatic environment such as on the surface 14 that is disposed near to a swimming pool, hot tub, spa, or the like.

A first base 102, a second base 104, a third base 106, and a fourth base 108 secure a first pedestal support 110, a second pedestal support 112, a third pedestal support 114, and a fourth pedestal support 116 thereto respectively. Each of the bases 102–108 are identical and so any of the pedestal supports 110–116 could be placed in any of them.

If for some special reason this were not desired, then certain of the bases could be made of a different size or with a different pattern of T-shaped members (see above) and arcuate slots (see above) that would allow only certain of the pedestal supports 110–116 to cooperate with them. For example, the first pedestal support 110 is used to provide support for a table 118 and an umbrella 120. If it were important to ensure that this particular pedestal support (the first pedestal support 110) could only cooperate with the first base 102, then a modification to both, as described above, is required.

In general, they are all identical so that the vast majority of pedestal supports 110–116 cooperate with the vast majority of bases 102–108, thereby permitting the maximum amount of flexibility in setup and use of the poolside accessory attachment system 100.

The prior mentioned copending application, entitled "Underwater Attachment System", filed on Dec. 31, 1998, application Ser. No. 09/224,418 by the same inventor is incorporated by reference herein. Accordingly, any of the pedestal supports 110–116 of the instant invention may be used underwater according to the disclosure contained in the "Underwater Attachment System" patent. The versatility that is provided when the two inventions are used together can be appreciated by those having ordinary skill in the art as a result of the benefit derived from the disclosure herein and in the aforementioned application.

The first pedestal support 110 includes a first upright pedestal 122 that extends to a predetermined distance above the surface 14 level. All of the bases 102–108, including the first base 102, are anchored to the structure that is disposed under the surface. As mentioned, this is typically either poured concrete or blown in place gunite although other materials may be used to form either the surface 14 or the underlying structures, as desired.

The table 118 may be any desired size or shape, and it may also be formed of any desired material. It can be attached to the first upright pedestal 122 so that it is an integral part of it, although a preferred embodiment is as shown where the table 118 includes an opening 128 in the center through which the first upright pedestal 122 passes.

A pin 130 passes through a first opening 132 through the first upright pedestal 122 and upon which the table 118 is supported. A second opening 134 is provided to adjust the height of the table 118. Additional openings (not shown) are included, as desired, to further adjust the height of the table 118.

An optional thermometer hook 136 is used to suspend a thermometer 138, if desired. An optional cable 140 is used to supply electrical power to the first base 102 and to a pair of contacts 142 that are attached to the first base 102 and to the first pedestal support 110 so as to cooperate with each other when the first pedestal support 110 is properly attached to the first base 102.

Electrical power is conducted up through the first upright pedestal 122 to an electrical outlet 144 where it is used by an electrical device 146. For safety reasons, low voltage direct current, such as 12 volts DC, is typically used because the first upright pedestal 122 may also be used in an underwater environment (not shown). However, conventional alternating current and voltage (i.e., 120 VAC) may be used, if desired.

It is noted that all of the features disclosed for use with any of the pedestal supports 110–116 are optional devices that are included at the discretion of the manufacturer in accordance with the individual needs of each consumer. As such, the use of electrical power is also optional.

A battery powered digital clock 148 is shown attached to the first upright pedestal 122 above the table 118 that does not require electrical power being supplied thereto through the cable 140. As such any battery operated device or appliance (not shown) may be similarly used with the poolside accessory attachment system 100.

The umbrella 120 includes a crank 150 useful to tilt the umbrella 120 and/or to open and collapse it, both of which are well known in the construction of umbrellas generally.

The umbrella 120 includes a pole 152 that extends down from the top of the umbrella 120 as far as desired. As shown, the pole 152 extends down into and entirely through the hollow interior opening (as exemplified by reference numeral 64 in FIG. 3) of the first upright pedestal 122, passing through an aperture (as exemplified by reference numeral 53 in FIG. 3) in the circular base plate (as exemplified by reference numeral 52 in FIG. 3) and through the hollow interior (as exemplified by reference numeral 28 in FIG. 2) of the center cylindrical member (as exemplified by reference numeral 26 in FIG. 1) of the first base 102 until contact with the bottom plate 29 occurs.

Having the pole 152 fit into the first upright pedestal 122 provides two benefits. The first, and perhaps the most important, is that the extra length of the pole 152 allows for the umbrella 120 to be positioned at whatever height (elevation) is desired.

The umbrella 120 is maintained at the desired elevation by tightening a wing-nut 154 that passes through a threaded opening disposed on one side of the upright pedestal 122 until it (the wing-nut 154) bears against the pole 152 and secures it in position. To remove the umbrella 120, the wing-nut 154 is loosened and the pole 152 is lifted to remove it from the first upright pedestal 122.

Secondly, the pole 152 supplies additional strength to the first pedestal support 110 assembly when it is disposed therein. When it is allowed to pass all the way to the first base 102, maximum support for the umbrella 120 is provided. This is an important consideration because when, for example, the wind blows there is considerable side-loading of the umbrella and therefore, of the first pedestal support 110 assembly, that occurs.

Attached to an edge of the table 118 is an infant seat 156 that includes a pair of arms 158 that are disposed on the top of the plane of the table 118 and a pair of sides 160 that are disposed under the table 118 and which, together, maintain the infant seat 156 in a position of cooperation with the table 18. An infant (not shown) is then placed in or removed from the infant seat from above. This provides a way to safely secure the infant in position proximate an aquatic environment thereby alleviating a certain amount of risk and attention that would otherwise have to be paid to the infant.

A floating chair 162 is shown tethered to the table 118 by a pair of tethers 164, each of which are attached to the table 118 by a hook and loop fastener 166 (as is sold under the tradename VELCRO). The floating chair 162 is normally not used when the table 118 is used on land and would therefore be removed apart from the table 118 if the table 118 were on the surface 14 and out of the water. The floating chair 162 is included only to illustrate the versatility of the poolside accessory attachment system 100 in that it can be modified to cooperate with strictly aquatic accessories, as desired.

The floating chair 162 is intended to represent any device that floats including floating lounge chairs and floating types of aquatic toys. The benefit thus provided is that the poolside accessory attachment system 100 can function as an aquatic center of interest where users can congregate to enjoy it in the water when it is used with an underwater-mounted base (not shown).

A stool 168 is attached to the top of the second pedestal support 112 and provides a seat that is disposed above the surface 14 level. A back rest 170 is shown in dashed lines to indicate a possible modification to the stool 168. When the back rest 170 is included with the stool 168 it is then more accurately referred to as being a chair. The second pedestal support 112 is clearly adapted to support either the stool 168 or the chair, as desired.

The third base 106 is disposed a predetermined distance apart from the fourth base 108 so that the third and fourth pedestal supports 114, 116 are properly positioned to receive a pin 172 that enters into the top of the third pedestal support 114 and a sleeve 174 that passes over the top of the fourth pedestal support 116. The pin 172 and the sleeve 174 are attached to the bottom of a bench 176. The bench 176 extends from the third pedestal support 114 to the fourth pedestal support 116 and, if desired, a small amount past them.

If desired a second pin (not shown) or a second sleeve (not shown) could be used as well, however this does not provide any method to ensure that the bench 176 is properly attached. If the bench 176 includes a curvature that matches that of, the table 118 for example, it may be desirable to guide a user in its proper installation which is quite simple. The bench 176 is merely oriented above the third and fourth pedestal supports 114, 116 and lowered into proper position so that the pin 172 enters into the third pedestal support 114 and the sleeve 174 passes over the fourth pedestal support 116.

This, of course, can occur only after the third and fourth pedestal supports have been properly attached to their respective third and fourth bases 106, 108. Removal of the bench 176 is merely a reversal of the procedures described.

Another advantage thus provided is that the user does not have to lift heavy or large component parts of the poolside accessory attachment system 100 when switching between locations. The bench 176 is moved as a unit and the third and fourth pedestal supports 114, 116 are each individually moved, as well.

Referring now also to FIG. 5, a second pole 200 is shown entering into a fifth pedestal support assembly 202, passing down into a fifth base 204 and extending down through the bottom of the fifth base 204 and to the bottom plate 29. The second pole 200 extends all the way to the bottom plate 29 to achieve maximum strength and support.

A backboard 206 is attached to the top of the second pole 200 to which a basketball rim and hoop 208 are attached. If desired, the table 118, umbrella 120, and pole 152 (of FIG. 4) can be removed from the first pedestal assembly 110 (of FIG. 4) and the second pole 200 can be substituted in their place. This shows the ability to position and to interchange various poolside accessories between various locations on the surface 14.

This type of an interchange of accessories would change the poolside area from that of primarily a lounging, eating, and shaded area into a sport-recreational area. If the second pole 200 were to extend below the level of the first base 102 (of FIG. 4) the cable 140 would have to be routed so as not to interfere with the second pole 200, if it were also included.

A sixth base 210 is shown with the plane of its top being disposed parallel to and slightly below the plane of the surface 14 and having a cover 212 attached thereto, the top of which is equal to the plane of the surface 14 level. This type of installation for the sixth base 210 is preferred and may be used for all embodiments as described hereinabove. The advantage is that when any of the pedestal support assemblies is removed and the cover 212 is added, a smooth surface even with the surface 14 results. This can prevent the user from stubbing his or her toes (not shown). The cover 212 twists on and off of the sixth base 210 as does the fifth pedestal support assembly 202.

Of course, any number of additional bases (not shown) may be positioned where desired (such as around the table 118) to provide for as many stools 168, chairs, or benches 176 as desired and where desired. Similarly, any number and type of modifications can be made to provide a modified pole (not shown) or modified pedestal support assembly to satisfy any requirement. For example, a pair of modified poles could be used to support a volley ball net (not shown). The variety of possible uses for the poolside accessory attachment system 100 are unlimited.

As another example, a tapered opening 214 (FIG. 4) is provided through the table 118 to permit placing a cup 216 therein. Similar improvements reflect the quality of components and the market they are intended to serve. A high end application of the table 118 would include a tiled surface 218 of any size, pattern, or location, as desired. This might be done in such a manner so as to match (color coordinate) the appearance of the table 118 with the border tile work (not shown) of a nearby swimming pool or a nearby hot tub.

Another example of a possible modification to the cable 140 would be the addition of fiber optic cables therein to act as a high-speed optical interface. A portable computer (not shown) when used on the table 118 could benefit from such an interface. Certainly the user would enjoy working at the "office of the future" while at home and when sitting on the stool 168 under the shade of the umbrella 120 by a swimming pool.

Figure 6:
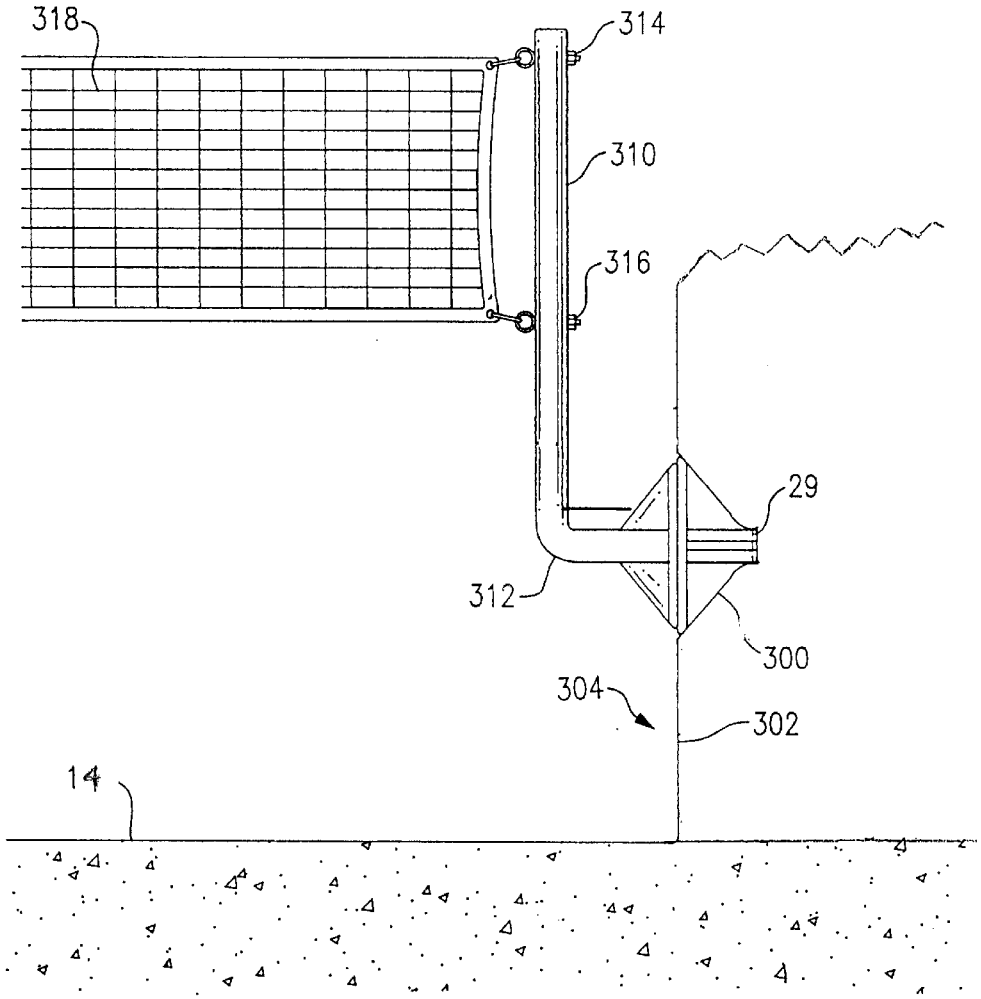
FIG. 6 is a side view of the poolside accessory attachment system with a modified base attached to the side wall of a structure (i.e. a building) having a modified pedestal support attached thereto.

Referring now to FIG. 6, is shown a modified base 300 attached to a side wall 302 of a building, identified in general by the reference numeral 304, of which only a portion is shown.

The modified base 300 is generally constructed identical with that of the base 10, the first base 102, the second base 104, the third base 106, the fourth base 108, and the fifth base 204 and is, instead, installed on the side wall 302 of the building 304 or other type of structure having the vertical side wall 302.

A modified pedestal support 310 is formed similar to those types previously described except that it includes a 90 degree bend 312 and, as shown, a pair of eye bolts 314, 316. The eye bolts 314, 316 hold the top and bottom of one side of a volley ball net 318. The opposite side (not shown) of the net 318 is similarly supported by a second modified pedestal support (not shown) attached to a second modified base (not shown).

In use, when the modified pedestal support 310 is installed in the modified base 300 it is installed at a slight angle so as to properly align the T-shaped members (not shown) with the large circular openings of the arcuate slots (not shown). The modified pedestal support 310 is then rotated so the T-shaped members reach the stops (not shown). At this time a terminal portion of the modified pedestal support 310 extends vertically above the surface 14 level. This allows use of the poolside accessory attachment system 100 in the side wall 302 of the building 304 or attached to the side wall 302 of any similar type of structure.

Of course, any number of other types of devices (not shown) are anticipated for use with the modified pedestal support 310 including stools, benches, umbrellas, basketball hoops and backboards, just to name a few.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A poolside accessory attachment system for use proximate an aquatic environment, comprising:

(a) a base adapted to be attached to a surface of a structure, said base adapted to be disposed on the ground; and (b) a pedestal support including means for attaching said pedestal support to said base and for removing said pedestal support from said base wherein said means for attaching includes a twist-on and twist-off mechanism wherein said twist-on and twist-off mechanism is adapted to permit rotation of said pedestal support radially and to prevent a change axially from occurring when said pedestal support is inserted into said base and when said pedestal support is removed from said base and wherein said pedestal support is disposed in substantially a vertical orientation and extending in a direction generally away from said base;

and wherein at least a portion of said base is disposed at a lower elevation than any of said pedestal support;

and wherein said pedestal support and any object attached thereto is adapted for insertion and use in the water.

2. The poolside accessory attachment system of claim 1 wherein said means for attaching includes a bayonet type of mechanism.

3. The poolside accessory attachment system of claim 1 wherein said pedestal support includes a table.

4. The poolside accessory attachment system of claim 3 wherein said table includes means for adjusting its position with respect to said pedestal support.

5. The poolside accessory attachment system of claim 3 including an infant chair, said infant chair attachable to and removable apart from said table.

6. The poolside accessory attachment system of claim 3 wherein said table includes a cup holder.

7. The poolside accessory attachment system of claim 1 wherein said base is disposed proximate a grade level.

8. The poolside accessory attachment system of claim 1 wherein said base is disposed a predetermined amount below grade level, and including a cover that is adapted for attachment to said base as a replacement for said pedestal support when said pedestal support is removed from said base wherein a top surface of said cover is disposed at grade level when said cover is attached to said base.

9. The poolside accessory attachment system of claim 1 wherein said pedestal support includes an umbrella.

10. The poolside accessory attachment system of claim 9 including means for adjusting the position of said umbrella with respect to said pedestal support and wherein said umbrella includes a pole and said pole is disposed in an opening provided in said pedestal support along a longitudinal length thereof and wherein said pole is adapted to move longitudinally therein and wherein said means for adjusting is adapted to secure said pole along said longitudinal length.

11. The poolside accessory attachment system of claim 1 wherein said pedestal support includes means for providing a source of electrical power.

12. The poolside accessory attachment system of claim 1 wherein said pedestal support includes means for securing a thermometer thereto.

13. The poolside accessory attachment system of claim 1 wherein said pedestal support includes a digital clock attached thereto.

14. The poolside accessory attachment system of claim 1 wherein said pedestal support includes means for attaching a stool thereto.

15. The poolside accessory attachment system of claim 1 wherein said pedestal support includes a chair attached thereto.

16. The poolside accessory attachment system of claim 1 including a plurality of pedestal supports that are adapted for attachment to a plurality of bases and a bench that is detachably-attachable with respect to said plurality of pedestal supports.

17. The poolside accessory attachment system of claim 1 including a pole adapted for use with said pedestal support, said pole including means attached thereto useful for playing a game.

18. The poolside accessory attachment system of claim 17 wherein said pole includes a backboard and a hoop attached thereto adapted for playing said game while at least one person is disposed proximate said pole.

19. The poolside accessory attachment system of claim 1 wherein said base includes reinforcing means for further securing said base to said structure.

20. The poolside accessory attachment system of claim 1 wherein said base is attached to a horizontal surface of said structure.

21. The poolside accessory attachment system of claim 1 wherein said base is attached to a vertical surface of said structure.

22. The poolside accessory attachment system of claim 21 wherein said pedestal support includes a modified pedestal support, said modified pedestal support including a portion that is disposed in substantially a horizontal direction and which includes a radius of approximately 90 degrees and a terminal portion that is disposed in substantially a vertical orientation and which extends in generally an upward direction.

* * * * *